US007686753B2

(12) United States Patent
Konzal

(10) Patent No.: US 7,686,753 B2
(45) Date of Patent: Mar. 30, 2010

(54) BOTTOM FINISHING STATION COMPONENTS FOR A CUP MAKING MACHINE

(75) Inventor: Daryl R. Konzal, Wauwatosa, WI (US)

(73) Assignee: Paper Machinery Corporation, Milwaukee, WI (US)

( * ) Notice: Subject to any disclaimer, the term of this patent is extended or adjusted under 35 U.S.C. 154(b) by 362 days.

(21) Appl. No.: 11/494,208

(22) Filed: Jul. 27, 2006

(65) Prior Publication Data

US 2008/0026924 A1 Jan. 31, 2008

(51) Int. Cl.
*B31B 1/00* (2006.01)
*E21C 47/04* (2006.01)

(52) U.S. Cl. ..... 493/157

(58) Field of Classification Search ..... 493/153, 493/157; 279/106, 107, 110; 269/66, 229; 29/281.1; 413/4, 5, 6, 27, 41, 43, 77
See application file for complete search history.

(56) References Cited

U.S. PATENT DOCUMENTS 2,942,531 A 6/1960 Loeser et at
4,349,400 A * 9/1982 Gilden ..... 156/217
4,409,045 A 10/1983 Busse
4,490,130 A 12/1984 Konzal et al.
5,337,622 A * 8/1994 Konzal ..... 74/813 R
5,569,143 A 10/1996 Konzal
5,584,789 A * 12/1996 Robertson ..... 493/153
5,752,907 A 5/1998 Konzal
6,558,305 B1 5/2003 Haggman
2006/0095151 A1 5/2006 Mannlein et al.

OTHER PUBLICATIONS

International Search Report dated Jun. 2, 2008.

* cited by examiner

*Primary Examiner*—Rinaldi I. Rada
*Assistant Examiner*—John Paradiso
(74) *Attorney, Agent, or Firm*—Andrus, Sceales, Starke & Sawall, LLP

(57) ABSTRACT

A cup making machine has a bottom finishing station provided with a mandrel for holding a sidewall blank and a bottom blank such that a flap portion of the sidewall blank is folded around a lip of the bottom blank. The bottom finishing station has a seam clamp engageable with overlapped edges of the sidewall blank to form a side seam, and a clamp ring selectively movable into engagement with the seam clamp. The clamp ring includes an annular wall forming a recess for receiving a rotatable tool which presses against the flap portion and the lip to form a bottom seal. Part of the seam clamp protrudes into the clamp ring, and part of the clamp ring protrudes into the seam clamp to form a bridge acting against the overlapped side seam at the top of the lip.

10 Claims, 7 Drawing Sheets

BOTTOM FINISHING STATION COMPONENTS FOR A CUP MAKING MACHINE

FIELD OF THE INVENTION

This invention relates generally to the manufacture of two piece seamed paper cups coated with thermoplastic, and more particularly, pertains to cooperating clamp components used in a bottom finishing station for creating a bottom seal between bottom and sidewall blanks of the cup.

BACKGROUND OF THE INVENTION

The assignee of the instant application, Paper Machinery Corporation of Milwaukee, Wis. USA is the manufacture of paper cup making machines used to make a variety of cups and containers. A typical cup machine for making paper cups, for instance, includes a turret having a plurality of mandrels about which the containers are formed. The turret sequentially rotates the mandrels into cooperation with a variety of work stations where numerous cup forming procedures occur.

In an exemplary procedure, a circular bottom blank is cut out at one workstation and attached to the end of a mandrel by a vacuum applied through the mandrel. During this procedure, the outside lip of the bottom blank is folded downwardly. At a subsequent workstation, a sidewall blank is wrapped around the mandrel. The sidewall blank is heated and sealed using a seam clamp along an overlapped side seam which runs generally longitudinally along the side of the cup. Typically, a paperboard or solid plastic sheet is coated with a thermoplastic material such as polyethylene, so the bottom and sidewall blanks may be heated and sealed together. In some applications, the sidewall blank includes a flap extending beyond the lip of the bottom blank, and this flap is bent over the lip. At a bottom finishing station, the flap is pressed against the lip from an inside recessed area of the bottom of the cup. By heating the polyethylene and firmly pressing the sidewall flap and the bottom blank lip together, a bottom seal is formed and the cup is provided with a sturdy bottom region having a recessed area. There may also be other worksations where various other additional cup forming procedures are carried out. For example, one station may be used to provide a curl at the top or rim of the cup to provide a more functional drinking container and a better appearance.

At a typical cup bottom finishing workstation, the bottom of the cup is finished by a knurling wheel which squeezes the bottom blank lip between the lower region of the sidewall and the sidewall flap. The knurling wheel is moved forward first into the recessed area on the bottom side of the cup. Then, the knurling wheel is moved laterally and then radially outwardly until it squeezes the sidewall blank, bottom blank lip, and the sidewall flap against an arcuate abutment wall of a bottom sealing clamp or clamp ring which receives the bottom of the cup. Once radially offset, the knurling wheel is rolled about the inside of the arcuate abutment wall until the entire bottom of the cup is pressed together and sealed.

In some bottom finishing stations, the lower flat end of the seam clamp is received in a U-shaped channel formed in the bottom sealing clamp or clamp ring (see FIG. 7A) where the overlapped sidewall seam meets the top of the cup bottom. This creates a common straight line joint between the two clamps at an area designated the channel. Over many years of cup production, the channel area has proven to be the most difficult location on the cup to seal thereby causing tiny leaks at the bottom seal of the cup. Channel area leaks cause cup rejection and high speed paper cup plants leading to production shutdowns which can be expensive. Thousands of cups can be produced before the leakage problem is analyzed or detected. Thus, it would be advantageous to provide cup bottom finishing components, namely, a seam clamp and a bottom seam clamp or clamp ring which eliminate the straight line joint therebetween and improve bottom sealing of the cup.

SUMMARY OF THE INVENTION

It is a general object of the present invention to provide a two piece cup having a bottom seal which is free of channel area leaks.

The present invention relates to a cup making machine having a bottom finishing station provided with a mandrel for holding a sidewall blank and a bottom blank such that flap portion of the sidewall blank is folded around a lip of the bottom blank. The bottom finishing station has a seam clamp engageable with overlapped edges of the sidewall blank to form a side seam, and a clamp ring selectively movable into engagement with the seam clamp. The clamp ring includes an annular wall having a recess for receiving a rotatable tool which presses against the flap portion and the lip to form a bottom seal. The invention is improved wherein part of the seam clamp protrudes into the clamp ring, and part of the clamp ring protrudes into the seam clamp to form a bridge acting against the overlapped side seam at the top of the lip.

The seam clamp is formed with a nose that is matingly received in a channel cut into the clamp ring, and is overlappingly engaged with an abutment rising upwardly on a planar top surface of the clamp ring. The nose is formed with tapering sidewalls, and the channel is formed in an upper portion of the clamp ring. The channel has a flat bottom wall and a pair of upwardly diverging sidewalls that terminate at the planar top surface of the clamp ring. The abutment is integrally formed on the planar top surface of the clamp ring. The abutment includes an upwardly angled sidewall, a flat top wall and a downwardly and outwardly sloping sidewall that merges with one of the upperwardly diverging sidewalls of the channel. Part of a length of the top wall and entire length of the downwardly and outwardly sloping sidewall protrude into a curved face of the seam clamp above the nose. An external contour of the abutment and the channel form a reverse S-shaped configuration. The clamp ring includes a cam roller assembly mounted on a bracket to a peripheral edge of the top planar surface of the clamp ring. The cam roller assembly includes a cam roller engageable with an adjustable bolt on a lower portion of the seam clamp.

In another aspect of the invention, a cup bottom finishing station is provided of the type for use with a cup making machine having a rotating turret with a plurality of mandrels. Each mandrel is configured to become an adjacent mandrel as it moves into position against a bottom finishing station. The adjacent mandrel is configured to receive a bottom blank having an outer lip and a sidewall blank having a lower region and a flap folded over the outer lip to create a recessed area in the bottom of the cup engaged by a finisher wheel. The bottom finishing station includes a seam clamp engageable with overlapped edges of the sidewall blank to form a side seam. A clamp ring is selectively movable into engagement with the mandrel and the seam clamp for forming a bottom seal of the cup. The clamp ring has an abutment wall defining a recess for receiving the finisher wheel. The seam clamp is formed with the nose that is matingly received in a channel cut into the clamp ring, and is overlappingly engaged with an abutment rising upwardly on a planar top surface of the clamp ring as the finisher wheel presses the lower region and the flap of the sidewall blank and the outer lip of the bottom blank against the abutment wall of the clamp ring.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
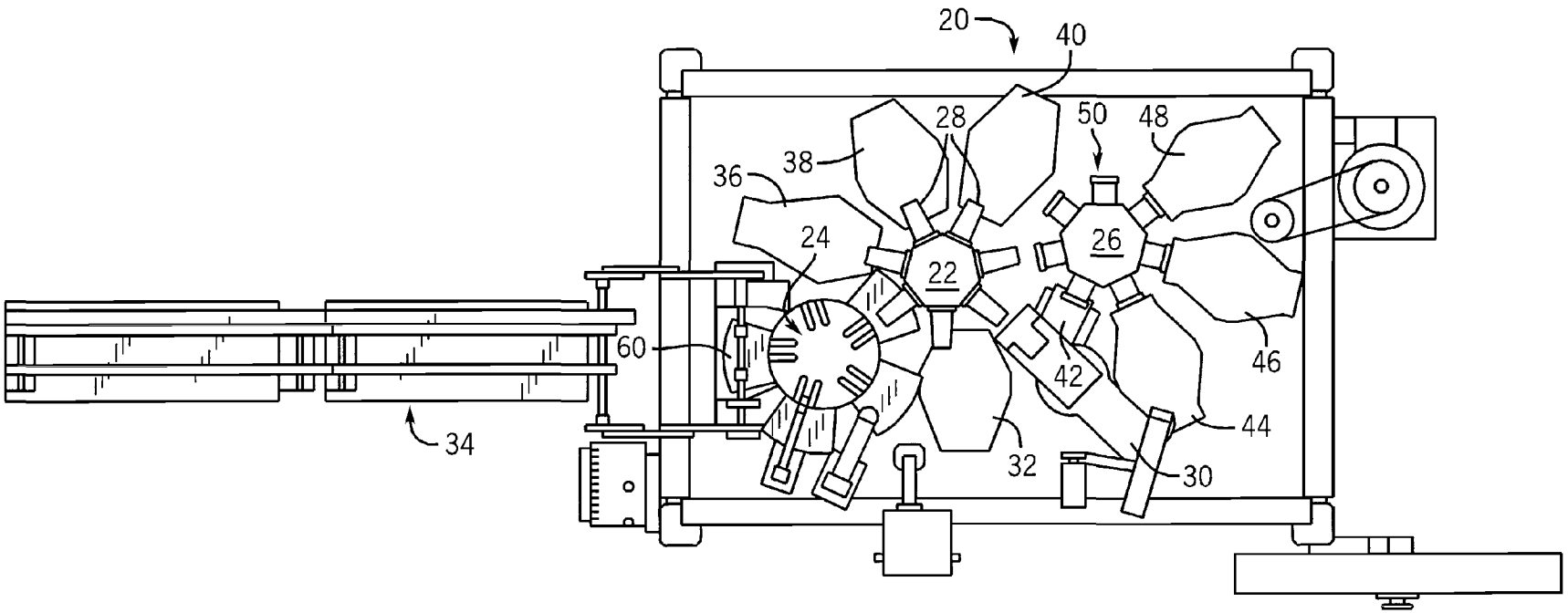
FIG. 1 is a schematic plan view of a cup making machine employing the bottom forming station components of the present invention.

Referring generally to FIG. 1, an exemplary cup making machine 20 is illustrated, this particular design includes a mandrel turret 22 which cooperates with a transfer turret 24 and a rimming turret 26. Mandrel turret 22 includes a plurality of frustoconical mandrels 28 that are rotated in a stepwise or indexing manner between surrounding workstations. For example, a bottom blank may be applied to a given mandrel 28 at a bottom maker station 30 and then rotated to a bottom reformer station 32. From this point, the mandrel 28 is rotated into cooperation with the transfer turret 24 which receives sidewall blanks from a hopper 34, and rotates the sidewall blank into cooperation with the cooperating mandrel 28. The sidewall blank is then folded about the mandrel 28 over the bottom blank, heated and sealed along a seam.

Next, the bottom blank and the sidewall blank are rotated to a bottom heat station 36. After heating, mandrel turret 22 indexes the subject mandrel 28 to a roller incurl station 38 where a portion of the sidewall blank, i.e. a sidewall blank flap, is bent over an outer lip of the bottom blank to form a recessed bottom in the cup. The cup is then moved to a bottom finishing station 40 where the sidewall blank flap and the bottom blank lip are pressed against the lower region of the sidewall blank to form a seal.

Once the bottom is formed and sealed, the cup is transferred to rimming turret 26 and rotated to a lube station 42 and then to a rimming precurl station 44 where the upper lip of the sidewall is curled outwardly. From that station, the cup is indexed to a rimming finish curl station 46 which finishes the curled portion along the top of the cup to make an attractive edge. At this point, the cup may be moved to an optional lid groover station 48 and then to a cup blowoff station 50 for removal of the finished cup.

Figure 2:
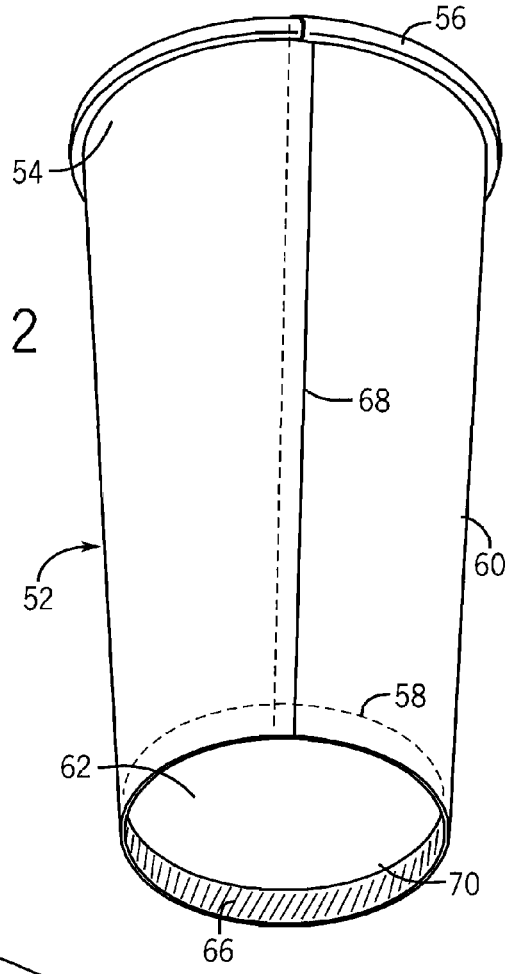
FIG. 2 is a perspective view of a cup made on the machine in FIG. 1.
Figure 3:
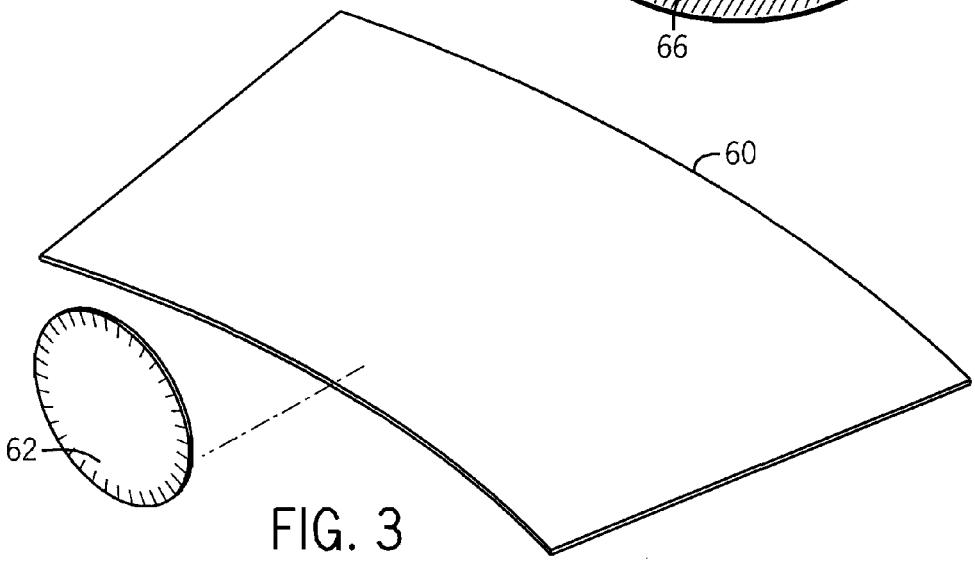
FIG. 3 is a schematic representation of the bottom blank and the sidewall blank combined to form the cup of FIG. 2.
Figure 4:
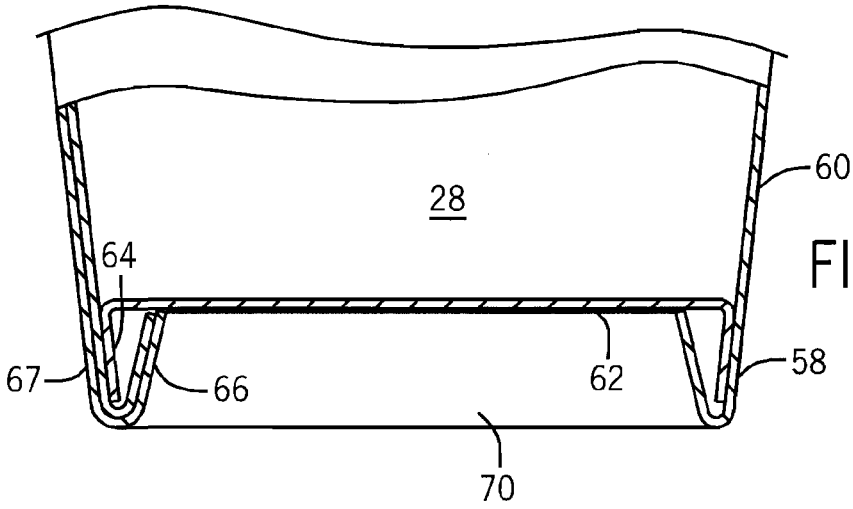
FIG. 4 is a sectional view showing the area at which the sidewall blank is joined to the bottom blank to form a bottom seal.
Figure 5:
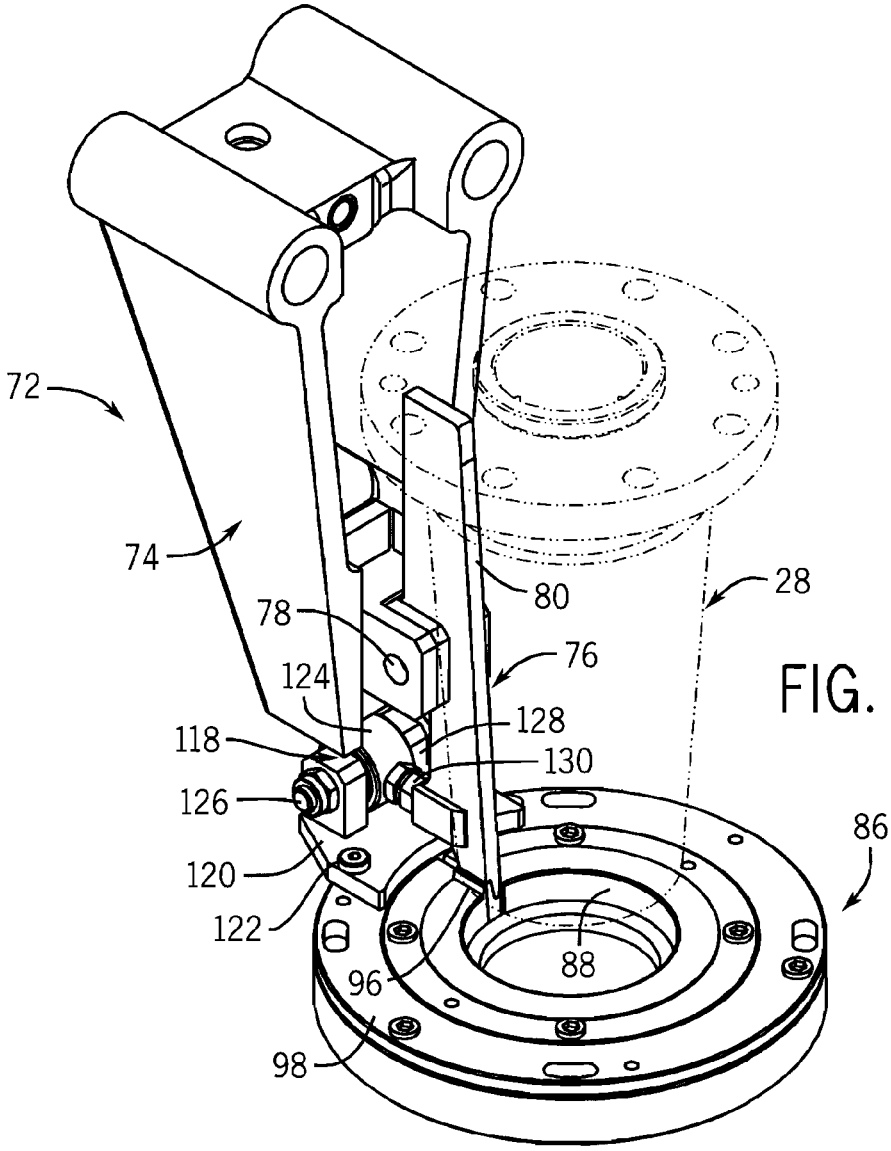
FIG. 5 is a perspective view of a portion of the bottom finishing station showing the seam clamp and the clamp ring of the present invention.
Figure 6:
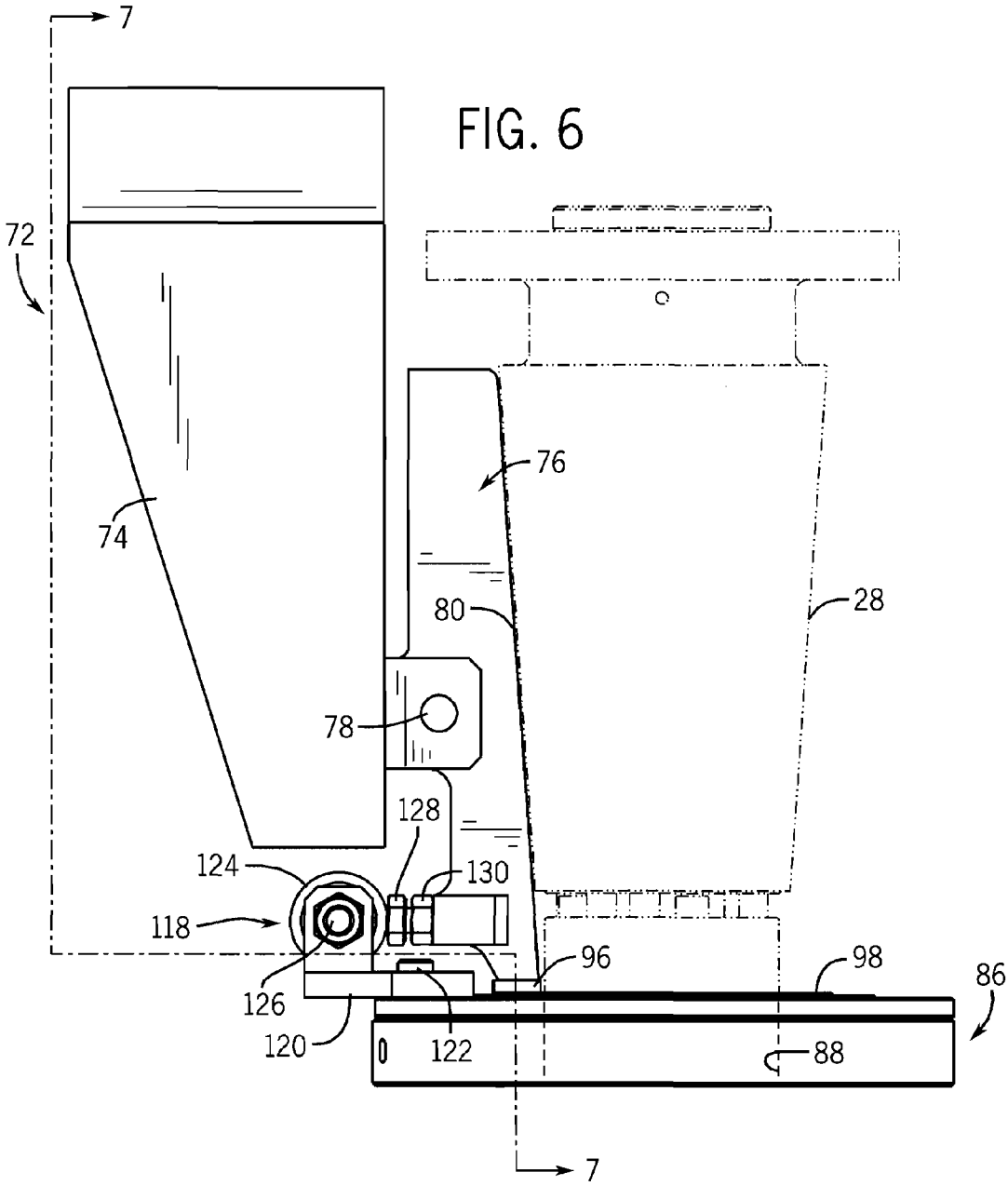
FIG. 6 is an elevational view of the seam clamp and the clamp ring of FIG. 5.

Bottom finishing station 40 can be sized and designed to make a variety of cups, and one example is illustrated in FIGS. 2-4. An exemplary cup 52 includes an upper region 54 having a curled rim 56 and a bottom region 58. Cup 52 is made from a sidewall blank 62 disposed generally transverse thereto. Bottom blank 62 is typically bent or folded over in proximity to its outer edge to form a lip 64. The sidewall blank 60 is located with respect to bottom blank 62 so that a flap portion 66 extends beyond lip 64. Flap portion 66 is bent or folded around lip 64 so lip 64 may be squeezed between flap portion 66 and a lower portion 67 of sidewall blank 60 (see FIG. 4).

A typical cup 52 is made from paperboard blanks having a thermoplastic coating such as polypropylene. The thermoplastic material permits heating and sealing of adjacent components. For example, when sidewall blank 60 is wrapped around bottom blank 62, the adjacent edges are heated and pressed together along a seam 68. The cup making machine 20 has the ability to create cups 52 with either a left over right seam 68 or a right over left seam 68. Similarly lip 64, flap portion 66 and lower region 67 of sidewall blank 60 may be heated and pressed together at bottom finishing station 40 to form a strong, leak-proof bottom region 58. By forming cup 52 as illustrated in FIG. 4, a recessed area 70 is created in the bottom of cup 52 on an opposite side of blank 62 from the main container region of cup 52. Recessed area 70 in the bottom of the cup permits insertion of a tool to press lip 64 and flap portion 66 towards the lower region 67 of sidewall blank 60.

Referring now to FIGS. 5-8, a seam clamp assembly 72 is positioned to engage and seal the seam 68 on the sidewall of the cup 52. In this regard, the sidewall blank 60 is wrapped around the mandrel 28 with the edges of the sidewall blank 60 overlapping on top of the mandrel 28. The seam clamp assembly 72 is held in an open or up position by air which on release allows the assembly 72 to engage the seam 68. The seam clamp assembly 72 includes a seam clamp arm 74 which is mounted for reciprocal movement by structure as more fully disclosed in U.S. Pat. No. 5,752,907 issued May 19, 1998 which is herein incorporated by reference. A seam clamp 76 is pivotally mounted about pivot pin 78 on clamp arm 74. The seam clamp arm 74 is free to pivot on pin 78 when a front edge 80 of the seam clamp 76 is moved into engagement with the tapered sidewall of mandrel 28.

Figure 8:
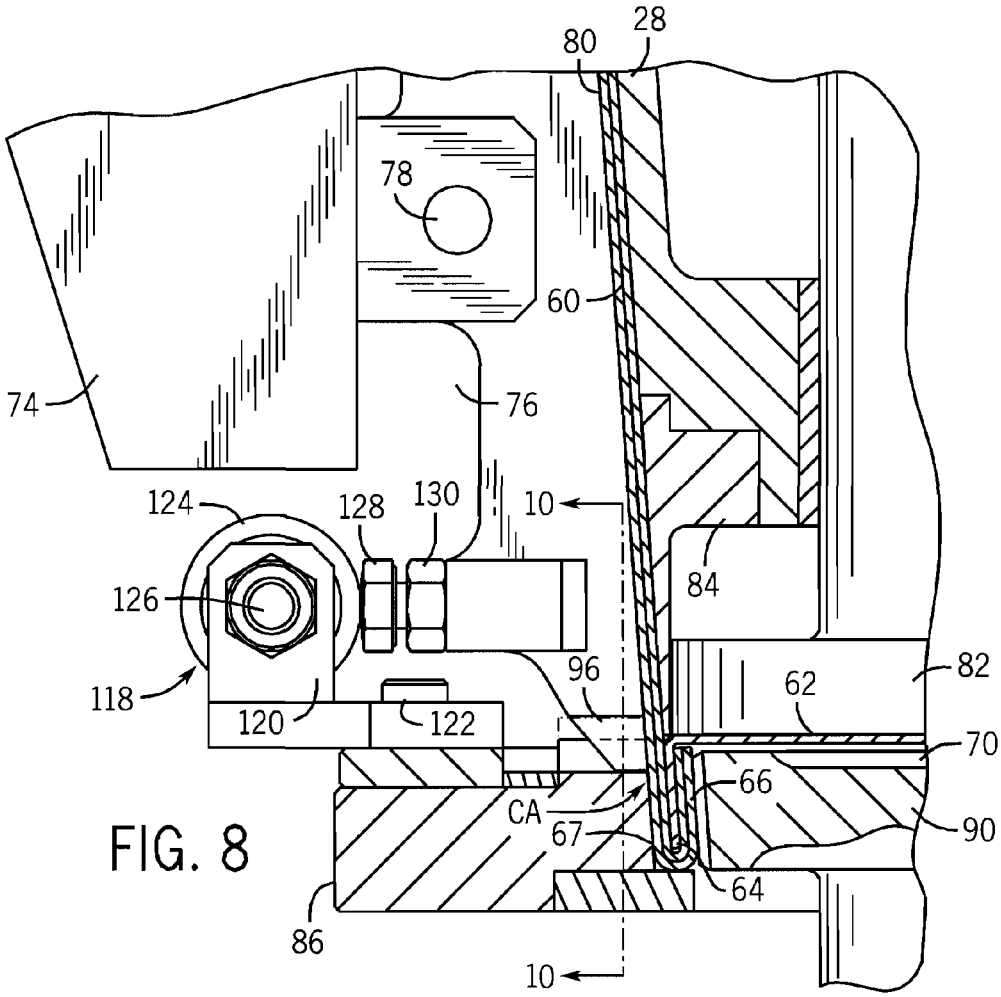
FIG. 8 is a partial sectional view of the seam clamp and the clamp ring in relation to the sidewall blank, the bottom blank and the knurling wheel.

After the bottom blank 62 has been heated at bottom heat station 36 and while the seam clamp 76 is engaged against the sidewall, a plunger portion 82 of the mandrel 28 moves away from a nose cone 84 of the mandrel 28 as seen in FIG. 8. This forces the lip 64 of bottom wall blank 62 into snug engagement with the bent lower portion of sidewall blank 60 at roller incurl station 38 to enable formation of a tight bottom seal at bottom forming station 40.

Besides the seam clamp arm 74, the seam clamp 76 and the mandrel 28 holding the sidewall and bottom blanks 60, 62 respectively, the bottom finishing station 40 includes a clamp ring 86. The clamp ring 86 is selectively movable towards and away from the bottom of mandrel 28 by a carriage assembly such as more fully described in U.S. Pat. No. 5,569,143 issued Oct. 29, 1996, which is herein incorporated by reference. The clamp ring 86 has an annular wall 88 that forms a circular recess for receiving a knurling wheel 90. As is known, the knurling wheel 90 is moved into and out of the recessed area 70 in the bottom of cups 52, and then moved radially outwardly until a pre-heated flap portion 66, lip 64 and the lower region 67 of cup 52 are squeezed tightly against wall 88 to help form the bottom seal.

Figure 7A:
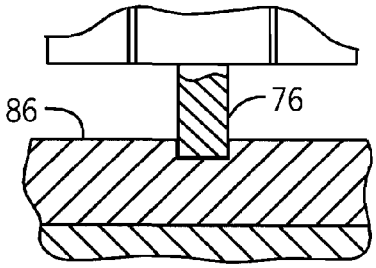
FIG. 7A PRIOR ART
FIG. 7A is a partial sectional view of a prior art seam clamp and clamp ring.
Figure 7:
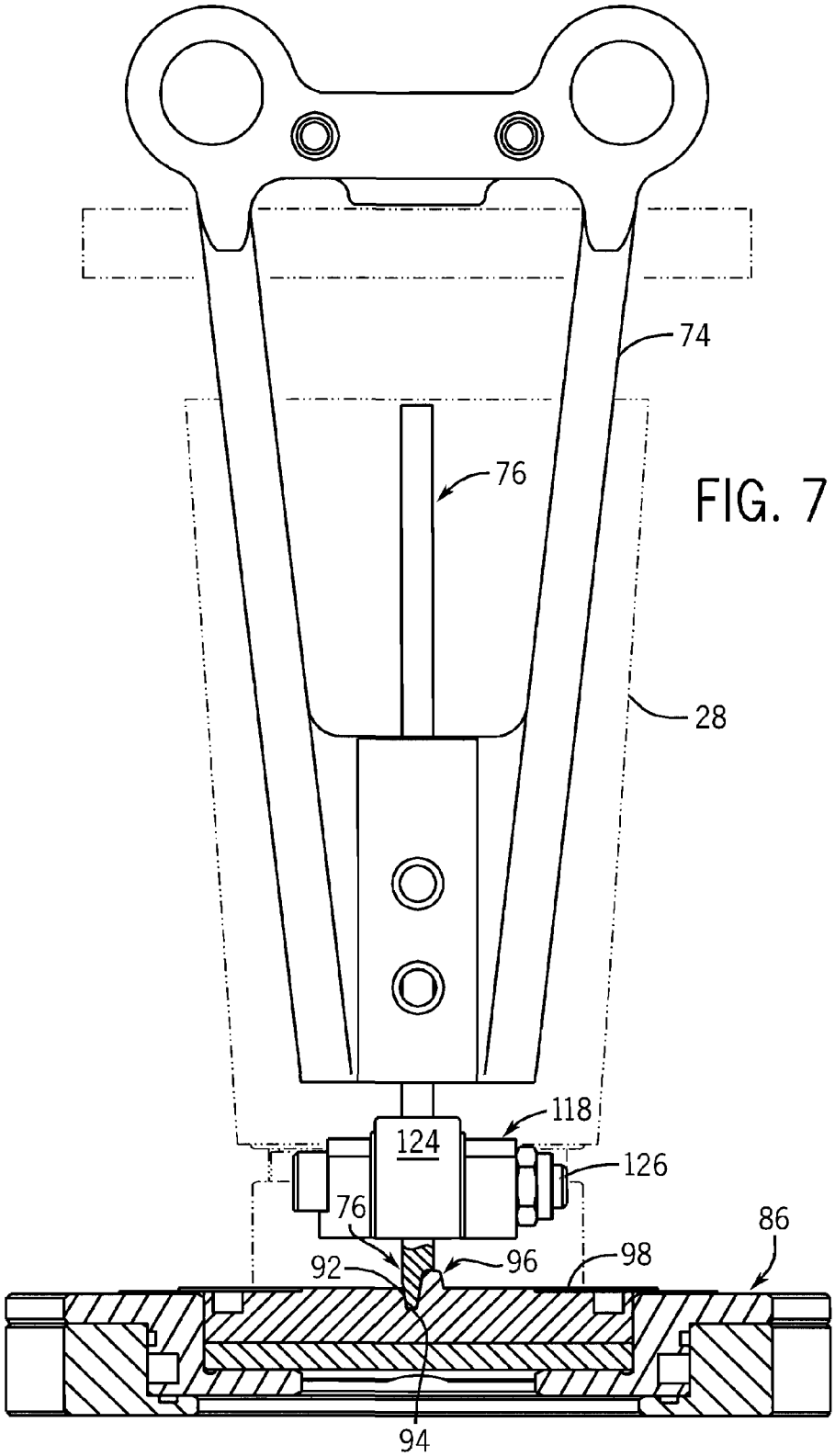
FIG. 7 is a sectional view taken on line 7-7 of FIG. 6.

In addition, pressure is applied to the channel area CA near the bottom of the cup 52 where the overlap side seam 68 meets the top of the bottom blank 60. As seen best in FIGS. 7-10, the lower end of the seam clamp 76 is formed with a nose 92 which is received in a channel 94 cut into the clamp 86, and is overlappingly engaged about an abutment 96 formed on the planar top surface 98 of the clamp ring 86. In contrast to the prior art relationship between the seam clamp and the clamp ring as shown in FIG. 7A, in the present invention, part of the seam clamp 76 namely nose 92, protrudes into the clamp ring 86, and part of the clamp ring 86, namely, the abutment 96 rising above the planar top surface 98, protrudes into the seam clamp 76. This creates an overlapping structure that provides a bridge for the pressure producing seam clamp 76 and the clamp ring 86 to act against the overlap of the side seam 68 at the top of the cup bottom or lip 64, and thus produce a continuous seal across the channel area CA so that leaks are eliminated.

Figure 10:
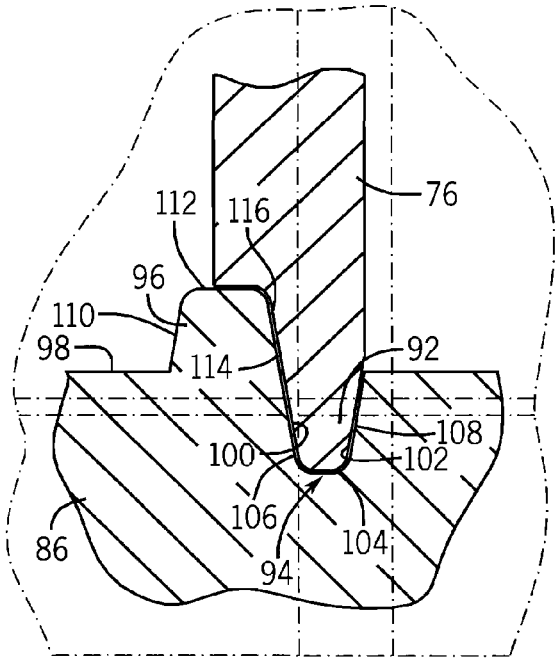
FIG. 10 is an enlarged, sectional view of the seam clamp and the clamp ring used in making a cup with a left over right seam, the view being taken on line 10-10- of FIG. 8.
Figure 9:
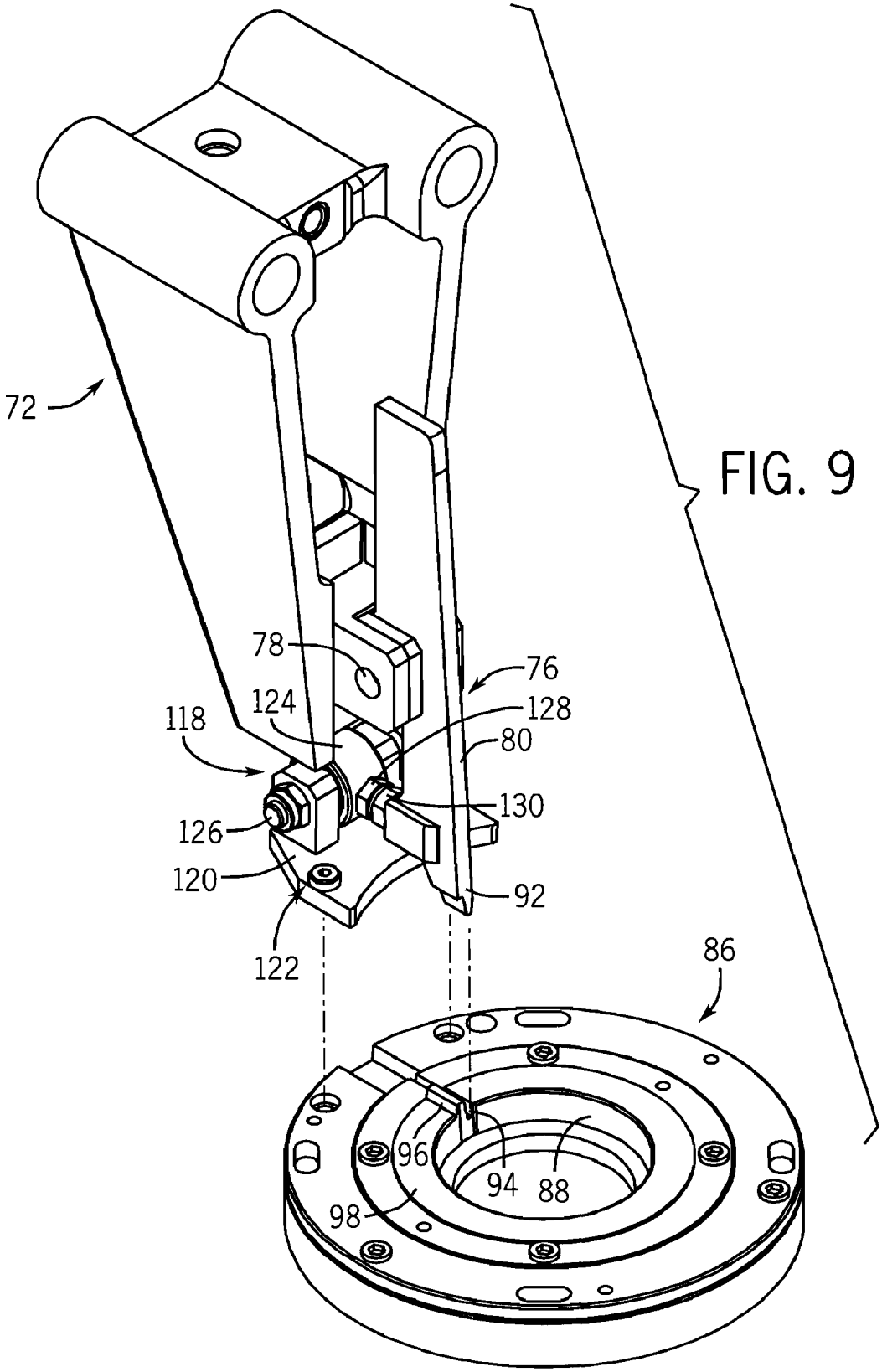
FIG. 9 is an exploded view of the seam clamp and the clamp ring.

In the preferred embodiment, the nose 92 when viewing the thickness thereof as seen in FIG. 10, has a finger-like shape with tapered sidewalls 100, 102 that are matingly received in the channel 94. As seen best in FIG. 10, the channel 94 is formed in an upper portion of the clamp ring 86 and has a flat bottom wall 104 and a pair of upwardly divergent sidewalls 106, 108 that terminate at the planar top surface 98 of the clamp ring 86. The abutment 96 is integrally formed on the planar top surface 98, and includes an upwardly angled sidewall 110, a flat top wall 112 and a downwardly and outwardly sloping sidewall 114 that merges with channel sidewall 106 at the planar top surface 98. About one half the length of top wall 112 and the entire length of sidewall 114 protrude into a curved face 116 of seam clamp 76 above nose 92. The overall contour of the channel 94 and the abutment 96 on clamp ring 86 forms a reverse S-shaped configuration or may be said to approximate a sinusoidal shape. When the lower end of the seam clamp 76 interfaces and overlaps with the contour of the clamp ring 86, there is no lateral shifting of the seam clamp 76 relative to the clamp ring 86 as the knurling wheel 90 forms the bottom seal.

Referring to FIGS. 5-9, to further improve the bottom seal, the movable clamp ring 86 carries a cam roller assembly 118 that is mounted on a bracket 120 held by fasteners 122 to a peripheral edge of the top planar surface 98. The assembly 118 has a cam roller 124 which rotates freely about a bolt 126. The cam roller 124 is engageable with an adjustable bolt 128 threaded into a member 130 on the lower portion of seam clamp 76. The cam roller 124 acts against the lower portion of seam clamp 76 which, in turn, acts against the sidewall seam 68 at the top of the cup bottom.

In operation, mandrel turret 22 is appropriately timed to interact with cup bottom finishing station 40. As each mandrel 28 moves another cup 52 into an area of cup bottom finishing station 40, the seam clamp 76 is engaged against the overlapped edges of the sidewall blank 60. The sidewall and bottom blanks 60, 62 have been heated and the bottom of sidewall blank 60 has been folded around the bottom blank lip 66. The clamp ring 86 is now moved towards the bottom of mandrel 28 until the bottom of mandrel 28 is received in the recess of the clamp ring 86. At the same time, the lower end of the seam clamp 76 and the clamp ring 86 interface in matingly relationship as described above to provide a bridge to act against the side seam 68 at the top of the cup bottom. At this point, the knurling wheel 90 is brought into the recess 70 in the cup bottom, and moved against the flap portion 66, the lip 64 and the lower region 67 of cup 52 to complete the bottom seal.

The present invention thus provides for improving the interrelationship of the seam clamp 76 and the clamp ring 86 used in a bottom finishing station 40 to form the bottom seal of a cup in a manner which avoids channel leaks.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim

1. A bottom finishing station for a cup making machine comprising:

a mandrel for holding a sidewall blank and a bottom blank such that a flap portion of the sidewall blank is folded around a lip of the bottom blank;

a seam clamp positioned adjacent and movable relative to the mandrel, the seam clamp being engageable with overlapped edges of the sidewall blank to form a side seam; and a clamp ring selectively movable into engagement with a bottom end of the seam clamp, the clamp ring including an annular wall forming a recess for receiving a rotatable tool which presses against the flap portion and the lip to form a bottom seal, wherein part of the seam clamp protrudes into the clamp ring, and part of the clamp ring protrudes into the seam clamp to form a bridge acting against the overlapped side seam at the top of the lip, and the clamp ring includes a cam roller assembly located thereon and engageable with a lower portion of the seam clamp that acts against the side seam at the top of the lip wherein the cam roller assembly is mounted on a bracket held by fasteners to a peripheral edge of a planar top surface of the clamp ring and includes a cam roller engageable with an adjustable bolt threaded into a member on the lower portion of the seam clamp.

2. The bottom finishing station of claim 1, wherein the seam clamp is formed with a nose that is matingly received in a channel cut into the clamp ring, and is overlappingly engaged with an abutment rising upwardly on a planar top surface of the clamp ring.

3. The bottom finishing station of claim 2, wherein the nose is formed with tapering sidewalls.

4. The bottom finishing station of claim 3, wherein the channel has a flat bottom wall and a pair of upwardly diverging sidewalls that terminate at the planar top surface of the clamp ring.

5. The bottom finishing station of claim 4, wherein the abutment includes an upwardly angled sidewall, a flat top wall and a downwardly and outwardly sloping sidewall that merges with one of the upwardly diverging sidewalls of the channel.

6. The bottom finishing station of claim 5, wherein part of a length of the top wall and an entire length of the downwardly and outwardly sloping sidewall protrudes into a curved face of the seam clamp above the nose.

7. The bottom finishing station of claim 2, wherein the channel is formed in an upper portion of the clamp ring.

8. The bottom finishing station of claim 2, wherein the abutment is integrally formed on the planar top surface of the clamp ring.

9. The bottom finishing station of claim 2, wherein an external contour of the abutment and channel form a reverse S-shaped configuration.

10. A cup bottom finishing station for use with a cup making machine comprising:

a mandrel configured to receive a bottom blank having an outer lip and a sidewall blank having a lower region and a flap folded over the outer lip to create a recessed area in the bottom of a cup engaged by a finisher wheel;

a seam clamp positioned adjacent and movable relative to the mandrel, the seam clamp being engageable with overlapped edges of the sidewall blank to form a side seam; and a clamp ring selectively moveable into engagement with the mandrel and a bottom end of the seam clamp for forming a bottom seal of the cup, the clamp ring having an abutment wall defining a recess for receiving the finisher wheel, the clamp ring including a cam roller assembly located thereon and movably engageable with a lower portion of the seam clamp that acts against the side seam at the top of the outer lip, wherein the bottom end of the seam clamp is formed with a tapered nose that is matingly received in a channel having upwardly diverging sidewalls cut into the clamp ring, and is overlappingly engaged within an abutment rising upwardly on a planar top surface of the clamp ring as the finisher wheel presses the lower region and the flap of the sidewall blank and the outer lip of the bottom blank against the abutment wall of the clamp ring, and wherein the cam roller assembly is mounted on a bracket held by fasteners to a peripheral edge of a planar top surface of the clamp ring and includes a ram roller engageable with an adjustable bolt threaded into a member on the lower portion of the seam clamp.

* * * * *